United States Patent [19]

Holtz, Jr.

[11] Patent Number: 4,469,514

[45] **Date of Patent: * Sep. 4, 1984**

[54] SINTERED HIGH SPEED TOOL STEEL ALLOY COMPOSITION

[75] Inventor: Frederick C. Holtz, Jr., Birmingham, Mich.

[73] Assignee: Crucible, Inc., Pittsburgh, Pa.

[ * ] Notice: The portion of the term of this patent subsequent to Jul. 17, 1990 has been disclaimed.

[21] Appl. No.: 513,058

[22] Filed: Oct. 8, 1974

Related U.S. Application Data

[63] Continuation of Ser. No. 279,942, Aug. 11, 1972, abandoned, which is a continuation of Ser. No. 435,733, Feb. 26, 1965, Pat. No. 3,746,518.

[51] Int. Cl.[3] ..... B22F 3/00; C22C 38/00

[52] U.S. Cl. ..... 75/236; 75/241; 75/126 A; 75/126 C; 75/126 D; 75/126 E; 75/126 F

[58] Field of Search ..... 75/236, 241, 242, 126 A, 75/126 C–126 F; 419/14, 15, 17; 420/442, 445–451

[56] References Cited

U.S. PATENT DOCUMENTS

| | | | |
|---|---|---|---|
| 2,855,295 | 10/1958 | Hansel | 75/126 |
| 2,961,312 | 5/1959 | Elbaum | 75/203 |
| 3,150,444 | 4/1962 | Reen | 29/182.5 |
| 3,244,506 | 9/1964 | Reen | 29/182.5 |
| 3,561,934 | 2/1971 | Stevens | 75/203 |

FOREIGN PATENT DOCUMENTS 781083 8/1957 United Kingdom .

OTHER PUBLICATIONS

Lymen, Metals Handbook, 8th Ed., vol. 1, ASM, pp. 638, 643, 644, 1961.

*Primary Examiner*—Brooks H. Hunt
*Assistant Examiner*—Anne Brookes
*Attorney, Agent, or Firm*—Finnegan, Henderson, Farabow, Garrett & Dunner

[57] ABSTRACT

Fully dense consolidated powder alloys of iron, cobalt and/or nickel characterized by having an ultrafine microstructure exhibiting a substantially uniformly dispersed harding phase of particle size essentially less than 3 microns, are produced from prealloyed powders by rapidly quenching an atomized molten alloy charge and subjecting the solidified alloy powder particles to the step of hot consolidation to produce substantially fully dense metal stock directly from prealloyed powder.

8 Claims, No Drawings

SINTERED HIGH SPEED TOOL STEEL ALLOY COMPOSITION

This is a continuation of application Ser. No. 279,942, filed Aug. 11, 1972, now abandoned, which is a continuation of application Ser. No. 435,733, filed Feb. 26, 1965 now U.S. Pat. No. 3,746,518, said application having the same inventor and being assigned to the assignee of the present invention.

The present invention relates to a novel process of producing both ferrous and non-ferrous alloys and to the novel alloy continuations and structures resulting therefrom. While not being limited thereto, the present invention has particular applicability in the production of materials such as high speed steels and cobalt-base cutting tool alloys.

Generally speaking, this invention consists of the steps of atomizing and consolidating a plurality of alloy materials as hereinafter set forth in detail, whereby both, the new alloys (in terms of composition) and alloys of novel metallurgical structure are readily and conveniently attained, both of said new materials illustrating considerably improved properties over known similar compositions of the prior art. Even more specifically, my invention is directed to alloy structures wherein there is a hard finely dispersed phase such as a carbide, but not being limited thereto, in a metallic or alloy matrix.

Another important aspect of my invention involves the formation of a uniform dispersion of, for example, very fine carbide particles throughout the major alloy constituent such as a cobalt-base matrix. Such carbide phase is finely grained (as hereinafter defined) and it is most important that it be substantially uniformly dispersed throughout the matrix.

A primary object of my invention is to provide for the uniform dispersion of finely dispersed phase hard particles such as, but not being limited to carbides, in an alloy matrix whereby considerable enhancement of metallurgical and physical properties result.

Another object of my invention is to provide non-ferrous alloys having exceptional properties.

Still another object of my invention is to provide ferrous alloys having exceptional properties.

A still further object of my invention is to provide a process of atomizing molten homogeneous alloy compositions and thereafter rapidly quenching the atomized homogeneous composition to form alloy powder which may be consolidated by known powder consolidation techniques.

Still a further object of my invention is to provide a method whereby wrought shapes may be fabricated of alloys heretofore considered unfabricable.

Still another object of my invention is to provide wrought alloys having greater volumes of hard dispersed phase, such as carbides, without a resulting loss of fabricability and toughness.

These and other objects, features and advantages of my invention will become apparent to those skilled in this particular art from the following detailed description thereof.

This invention is applicable to high-speed steels, cobalt-base alloys and other alloys containing refractory hard compounds in a metallic matrix.

The process first impinges a stream of high-velocity inert gas (e.g. argon) on a stream of molten metal as it issues from the atomizing nozzle. The stream atomizes into fine droplets, which are cooled to near room temperature in a fraction of a second. This drastic quench retains most of the carbide in solid solution.

In the second step of the process, the atomized powders are consolidated by methods such as conning followed by forging or hot rolling. During this operation, the carbide phase forms as an ultrafine precipitate; care must be taken to avoid excessively high working temperatures so that the carbides do not become coarse. After bar stock is produced, the jacketing material is removed and, in the case of high-speed steel, the material is hardened and tempered.

Some idea of the grain refinement and hardness levels made possible by this technique may be gained by comparing commerical T9 high-speed steel with an atomized high-speed steel alloy based on M15 steel but containing 10% vanadium and 3% carbon by weight.

| | Commercial T9 | Atomized Alloy |
|---|---|---|
| Carbide Volume | 10–15% | 30–35% |
| Carbide Particle Size (microns) | 2–10 | 1.5 or less |
| Matrix Grain Size (microns) | 10–25 | 3 or less |
| Hardness | 84.5 Ra | 87 Ra |

These atomized and consolidated alloys have transverse-rupture strengths of about 500,000 psi at hardness levels approaching 70 Rc. The ultrafine matrix grain size indicates very promising toughness characteristics. The finergrained alloy has improved cutting performance.

Atomizing techniques have also been used to prepare highly refined cobalt-chromium-tungsten-carbon alloys, commonly referred to as "cast alloys." Atomization and consolidation produce a hard, tough alloy having extremely fine carbides.

In the preferred practice of the instant invention one of the first and most important concepts involved is that of producing the initial form of the alloy as a powder by an atomizing process. This atmoizing process involves the prerequisite of generating a molten stream of the alloy, in which all of the alloying components are included, and in which all of the alloying constituents or phases are understood to be either completely liquefied or dissolved.

Preferably the molten stream is heated to a temperature that is at least about 100° F. to 200° F. above the fusion temperature of the alloy. It is an important aspect of the invention that the dispersed phase carbides are dissolved in this molten stream and remain primarily in solution not only during atomizing fluid (e.g. gas) impact on the stream but even after solidification of the resultant powders. The fact that such carbides are clearly submicroscopic in size and presumably in solid solution is borne out by subsequent examinations of the powders. The consolidated alloy (which is formed by a process necessarily effecting some increase in the dispersed carbide particle size) still has extremely minute carbide particle sizes. It will be appreciated that any sort of heating and/or pressure conditions over a given time period which would tend to consolidate a powder into a solid alloy mass would also tend to cause at least a limited or nominal amount of growth and/or agglomeration of dispersed phase carbides. The alloy powders of the invention (and their resulting consolidated alloys) are unique in that such growth and/or agglomeration is extremely nominal and the dispersed phase does, in fact, remain substantially uniformly discrete and dispersed throughout the continuous phase constituents forming the matrix of the present alloy. This result is made possible by the initial atomizing technique which has the net effect of distributing the dispersed phase carbides and the maxtrix elements in such a uniquely fine and uniform distribution that the unusual results of the invention are made possible.

In the treatment of the alloy composition in accordance with the instant invention, it has previously been mentioned that one important part of this treatment is the generation of a free-flowing molten or liquid single phase stream of the alloying composition. Generally this is done by the melting of the alloying composition (with all of the alloying ingredients included therein) in an adequate crucible and permitting the free-flowing stream to flow by gravity into the area of gas impingement. On the other hand, the gas or atomizing medium or fluid that is used is inert (to the material being atomized) and it may be preheated to extremely high temperatures so that it actually imparts sensible heat to the flowing stream of the alloy and thereby might assist in increasing the molten alloy temperature above that actually obtained in the crucible or container in which the alloying composition is initially melted, but this is generally neither necessary nor preferred. In fact, plasma or other atomized molten alloying composition generating devices which are known, may be used; but presently the most practical procedure calls for a cooling inert gas.

Such inert gas used is preferably argon, but the gas may be, as for example, $N_2$, $CO_2$ or, in fact, any of the known so-called gases which are elements of the "O-group" of the Periodic System, which include helium, krypton, etc. It will be appreciated that the chemistry of this procedure suggests that the inert gas used be argon, unless for some reason any of the alloying elements or trace chemical elements present in the alloy has no peculiar sensitivity to nitrogen or $CO_2$, which would then make one of these less expensive fluids more economical.

In the present example, argon is caused to impact or impinge against the free-flowing stream of molten one-phase alloy under substantial pressures and at substantially great speeds. The speed is relatively difficult to measure and it is not practical to evaluate the impacting on the basis of speed alone, since the actual impact-impingement effect is based both upon speed and gaseous weight (which latter factor is in turn determined by the temperature). The argon (or other inert gas) is preferably used at ambient atmospheric temperatures for the reason that the inert gas functions essentially to impinge and impact against the stream, so as to break up the molten alloy stream and then to violently agitate the broken stream, which is in the form of droplets in the continuous highly agitated gaseous phase, to the extent that the droplets are reduced materially in size while retaining their initial homogeneous composition in such droplets before actual solidification thereof, even though such solidification is so rapid essentially a solid single phase and/or supersaturated type of solid solution is actually obtained in this process. In other words, merely breaking up the molten stream by impingement is not sufficient, but the violence of the pressurized gaseous impact (or other dispersing medium) must be sufficient to effect continued agitation of the molten droplets for a very brief but effective period of time, whereby the impingement effect is actually continued during such agitation and the droplets are reduced to the sizes of the powder hereinafter described (as mesh sizes for the solidified powders), but their cooling during all of this is not delayed to the extent that their inherent dispersed phase (i.e. carbide) becomes microsopically (to any extent) discernible during solidification of the powders.

The alloying composition, from a chemical point of view, is ordinarily given on the basis of chemical analysis reciting the individual elements and it is virtually impossible to attempt a composition definition in any other terms, because of the difficulty of ascertaining exactly what type of chemical compounds, for example, might be formed in a given specific location of any particular alloy. Hence, the alloying composition and the composition per se of the alloys used herein will be given strictly speaking on the basis of the actual chemical elements employed.

One chemical composition of the alloy contemplated for use in the practice of the instant invention may be described as consisting essentially of 10% to 45% Cr, 1% to 3.5% C, (40-x)% W, x% M, remainder substantially Co, plus inherent trace amounts of impurities having selective preference to accumulate at phase boundaries, wherein x is a percent ranging from trace amounts to substantially 20% and M is an alloying metal selected from the group consisting of Fe, Ni, Cb, Ta and mixtures thereof. It is well known, of course, that Mo may be substituted for W in an approximate ratio of one part of Mo for two parts of W. Such substitution is within the scope of the invention. More specifically, one alloy of the invention is considered to be a cobalt alloy (i.e. containing at least substantially 35% Co) containing substantial quantities of chromium, preferably within the range of about 14 to 35% by weight (and it will be appreciated that all percents herein are given by weight unless otherwise specified). In addition, this cobalt-chromium alloy contains a substantial quantity of tungsten, with trace or with comparatively minor amounts of the various other alloying metals previously specified. Also, the instant alloy contains carbon, preferably in amounts above about 1½% and up to about 3%. Prior art alloys of the cobalt-chromiun-tungsten type could not include carbon in proportions above about 1.5% without obtaining an as-cast alloy that was substantially completely unworkable, or was at least so difficultly workable that it had to be cast is approximately the shape ultimately contemplated for use and could then perhaps be forged or wrought only with considerable difficulty. Conventional prior art as-cast alloys of this type have been made using carbon contents above 2.5%, whereas the instant invention affords unusual advantages in permitting the use of high carbon contents in workable alloys.

It is generally understood that the dispersed phase in the cobalt system will consist primarily of carbides. Also, it is generally understood that the dispersed phase in a cobalt-chromium-tungsten alloy, forming the subject matter of the instant alloy, will be predominantly tungsten carbide (but with some chromium carbide). Other alloying metals are included, however, and these various metals include such typical carbide formers as Mo and Cb. Although it is generally believed that substantially all of the Co remains in the continuous or matrix phase, it is believed that the other elements partition between the continuous phase and the carbide phases. Again, it will be understood that molybdenum is readily compatible with the instant cobalt-chromium-tungsten-carbide system and the previously mentioned percentage indicated by "x" may consist substantially entirely of molybdemum (see alloy E hereinafter), because of its similarity to W in behavior in this system. In contrast if these relatively minor proportions of other alloying elements are used, it is generally found that they are preferably used in amounts that are not substantially in excess of about 5%, and in those cases in which either iron or nickel is used as an alloying element it is generally preferable to use both materials, each in proportions less than substantially 5% and totalling less than substantially 9%. It will thus be seen from the subsequent formulations shown for the chemical compositions on Table I that although molybdenum is used in proportions as high as 7.5%, it may be used in an amount of at least 20% particularly as a substitute for its sister element W. It may also be used in lower proportions and in combinations with various of the other alloying materials such as iron and nickel hereinbefore described, the alloys which do contain iron and nickel ordinarily contain both of these elements and they are in amounts preferably of less than 4% in each instance. In the case of columbium (which may be completely replaced by its sister element Ta), it is used only with care in amounts more than 5% (as indicated in alloy k), but columbium is *not necessarily preferably* used in combination with the other previously described relatively minor alloying metals such as molybdenum, iron and nickel. Also, it will be seen that none of these alloying metals used in *x%* need be used in measurable chemical quantities in the composition, although it must be understood that it is generally a practical impossibility to avoid at least trace proportions of at least some of these to appear in the alloy (as in the case of the alloy of alloy H on Table 10, and it is for this reason that the percentage range for the figure "x" is indicated as ranging from trace amounts to substantially 20%. Likewise, the formulation for each of the alloys is described in terms of the identifiable chemical elements present therein, which are readily identified, and the remainder is described as being substantially cobalt, but with the obvious understanding to those skilled in the art that absolute purity in the case of any of these metallic elements is almost a practical impossibility and the remainder of substantially cobalt must be understood to contain inherently minor amounts (generally not totalling in excess of about 0.5%) of P, S, O, N or the like impurities as well as at least trace quantities (and perhaps as much as 2½%) of other compatible alloying metals, which are not identifiable readily in chemical composition and which substantially dissolve or otherwise disappear in the overall alloy structure, such that their presence, if it does exist, is not significant either from the point of view of chemical composition or from the point of view of the ultimate alloy structures here obtained. It will be understood that whenever trace materials might be contained in the so-called "remainder substantially cobalt" these trace materials will either not be deleterious to the ultimate alloy structure or they will be in the form of the aforesaid minute quantities of impurities and the impurities will not include anything more than trace quantities of additional carbon (since the carbon content is designated in each case). Readily compatible alloying metals which would have no effect upon the ultimate alloy composition and do, in fact, have no ultimate effect upon the alloy structure may be included and they are treated as being substantially inert (even though readily cpompatible) metallic ingredients in this particular alloy system.

In forming the alloys referred to in the subsequent Table I, the total amount of molten alloying composition used was five pounds, heated in each case to a temperature of substantially 2800° F., and fed by gravity as a free falling stream of ¼ inch diameter through an orifice of ⅝ inch diameter downwardly into the atomizing vessel, which was sealed against ambient atmosphere. Surrounding the molten alloy orifice is a (conically) annular orifice aimed to impinge 2 to 3 inches below the alloy orifice exit, having an annular radial dimension of 0.05 inch through which argon at ambient temperature was fed using an argon back pressure on the orifice of 350 pounds per square inch, gauge. The overall volume of the gas space in the dispersion vessel is substantially 8 cubic feet and the vessel was sealed except for peripheral argon pressure bleed-off vents, at which the argon is bled from the vessel at substantially ½ to 10 pounds per inch gauge pressure. This results in not only impact-impingement of argon streaming around the periphery of the downwardly flowing molten stream of alloying composition, but it also results in violent swirling or agitation within the dispersion chamber to the extent that the molten stream is converted first to molten droplets which are in turn almost instantaneously reduced to very fine size molten droplets initially liquid before the substantially instantaneous quenching thereof, which is obtained in the atomization process substantially before particles reach the bottom of the atomizing vessel.

At the bottom of the atomizing vessel water is introduced initially at temperatures within the range of 33° F. to 50° F. to form a pool at a relatively low level but upon initiation of atomization the warm solidified particles appear to drive water liquid and/or vapor peripherally upward in the atomizing vessel. Thus, after the process begins the coolant water circulates in the atomization vessel. By this means the droplets are quenched in an extremely rapid manner so that all or substantially all of these droplets retain their minute discrete size and are non-agglomerative or non-tacky in character in the argon even before reaching the water.

In fact, the total time which the molten alloy takes from the entrance of the molten stream via the orifice to the quench to non-agglomerative particles is very brief, such that the droplet formation in the discrete particle size desired (and ultimately measureable in the solid powder form) is obtained by the gaseous impact very rapidly and the agitation effect and quenching of the violent circulation of gases above the water pool is such as to generally cause uniform particle size formation, but not completely uniform size formation as the subsequent solidified powder mesh sizes indicate. Essentially, the impact of the gases carries out the function of reduction to the very fine droplet size so that the quenching in the gases will also cause extremely rapid solidification and thus preclude agglomeration of the particles per se and also prevent excessive precipitation of the submicroscopic dispersed phase (i.e. carbides) in this particular alloy.

The separation of the solidified powders from the water pool is, of course, a simple matter of passing these through a suitable strainer and/or passing the wet powder into a suitable low temperature evaporator or drier, so that the powdered alloy particles are then obtained in a desired condition. The mesh sizes are indicated at the end of Table I.

The foregoing Test described in the formation of the alloy powders is carried out using each of the compositions hereinafter set forth in Table I in the various alloys numbered A through M.

TABLE I

| Alloy No. | CHEMICAL COMPOSITION Cr | W | Cb | Mo | Fe | Ni | C | Rem. Subst. Co. |
|---|---|---|---|---|---|---|---|---|
| *A 7 | Commercial Tantung | | | G | — | — | — | |
| *B | Commercial Tantung | | | 144 | — | — | — | |
| C 26 | 35 | 17.5 | — | — | — | — | 2.5 | " |
| D 34 | 35 | 17.5 | — | — | — | — | 2.5 | " |
| E 35 | 35 | 10 | — | 7.5 | — | — | 2.5 | " |
| F 45 | 32 | 17 | — | — | 3 | 2.5 | 2.5 | " |
| G 46 | 31 | 16.5 | — | 3 | 2.9 | 2.4 | 2.4 | " |
| H 47 | 35 | 17 | — | — | — | — | 3 | " |
| J 48 | 35 | 10 | — | 5 | — | — | 2.5 | " |
| K 49 | 35 | 15 | 4 | — | — | — | 2.5 | " |
| L 50 | 25 | 27.5 | — | — | — | — | 2.5 | " |
| M 51 | 14.2 | 38.3 | — | — | — | — | 2.5 | " |

*These are commercial alloys, for which exact composition is unavailable.
Note (1) Typical mesh sizes are 10% above 80 mesh, 70% in the range of 80 to 325, and 20% less then 325 mesh.
Note (2) Dispersed phase in the free-flowing powders in the alloys A through M are of substantially submicroscopic size.

After cosolidation the nominal growth of the dispersed phase (e.g. carbides) has occurred to the extent that they are substantially within the range from ½ micron to 3 microns.

After the consolidation process (described hereinafter in detail), observation indicates that dispersed phase (e.g. carbides) nominally agglomerates and/or grow in size to sizes discernible or resolvable in an optical microscope which indicates size ranges more closely to ½ to 1½ to 2 to 3 microns, and with substantially homogeneous uniform dispersion of the alloying materials and dispersed phase (e.g. carbide).

The consolidation of the separate alloys was carried out by a hot working technique protecting the alloy composition. In the present instance, only those powders from the tests passing the 80 mesh screen were collected separately in amounts of substantially 200 grams and sealed in a thin (i.e. about 0.1 inch) steel jacket (or "Inconel" when preferred) that was functionally inert relative to the alloy powder but protective from ambient atmosphere, etc.; and the canned powder specimen was forged after heating to a billet temperature of 2175° F., and then hot rolled to substantially an alloy sheet of 0.060 inch thickness at hot working billet temperatures for such powder and resultant alloy sheet of substantially 2150° F. It is understood that hot working involves a pressure as well as a temperature and time conditions, but the temperature can only be expressed as billet temperatures and should not be above substantially 2175° F., however, if there is an increase in the consolidation pressure a corresponding decrease in temperature will be most advantageous as this will prevent undue carbide growth and/or agglomeration. The pressures, being impractical to evaluate numerically, are those sufficient to the skilled worker to forge and/or roll the canned alloy thus heated to sheet thickness (or other shape, if such is desired) specified using conventional alloy hot working equipment and pressure ranges.

Although substantially the same hot working conditions (i.e. 2150° F. to 2175° F., rolled to 0.060 inch sheet) were used in these particular tests, comparable results are obtained by hot working to conventional sheet thicknesses at temperatures within the ranges of 1800° to 2175° F., which are below the drastic pressure-temperature conditions which tend to cause substantial agglomeration of the dispersed phase (i.e. the minute carbides which are predominantly WC). A 2000 magnification of the resulting alloy product of the invention, using (as typical) the consolidated alloy C of Table I compared to the same alloy composition (which is not capable of cold or not working under conventional conditions) but initially cast by conventional co-fusions of the components into a solid alloy mass according to prior art procedure would show a striking and marked difference between the two above mentioned alloys. The latter alloy (formed by prior art techniques) would show massive carbide alloy constituents which are more or less continuous through the alloy whereas the alloy formed by the present invention should show fine substantially uniformly distributed carbide alloy constituents which are discrete and definitely discontinuous. As the following Table II shows, for the same chemical compositions, these differences are verified numerically in rupture strength and Rockwell C hardness tests performed on the respective alloy structure (both before and after heat treatment). It will be understood that the massive carbide phase sizes for the alloy formed by prior art methods leave this as-case alloy with virtually no tensile elongation up to its actual melting point, hence the impossibility of cold or hot working before the microscopic investigation.

TABLE II

| Preparation Method | Transverse Rupture Strength (psi) | Hardness Rockwell C |
|---|---|---|
| Conventionally Cast | 220,000 | 60–62 |
| Atomized and Consolidated | 396,000 | 61–62 |
| Alloy of FIG. 2 after heat treatment by being aged 150 hrs. at 1350° F. | 298,000 | 66–67 |

The heat treated alloy has unusual hardness and exhibited greatly improved cutting performance and tool life, as compared to the conventional cast alloy. Also, the initially consolidated sheet (as per the invention) was approximately 80% stronger than the conventionally cast alloy; and this extremely greater strength affords obvious advantages in the consolidated form of the hot rolled sheet, although such sheet is capable of the heat treatment described to harden while still maintaining its rupture strength superior to that of the conventional cast alloy, thereby affording the unique advantage of substantial increase in hardness of this heat treated material over the conventional cast alloy as well as the atomized and hot rolled alloy. Such heat treatment of the atomized and hot rolled alloy is also found to effect substantially no disturbance of the highly desirable fine uniformly dispersed phase (i.e. carbide).

The aforesaid consolidation with all of the other tests powders and also the subsequent aging (which can be performed at 1200° F. to 1500° F. for respectively 200 hours to 20 hours) give correspondingly superior results.

During or prior to atomization the alloying composition in the liquefied droplets is heated or otherwise converted to a single metallurgical phase, in liquid form; and this effects, with the present rapid quenching, particles which contain minute submicroscopic dispersed carbide phases. The dispersed phase is characterized by a structure generally within substantially the size range of ¼ or less up to slightly less than about 3 microns even after consolidation. These features evidence in the metallurgical structure of the alloys of the invention a radical and critical departure from conventionally prior art as-cast alloys of the same chemical composition.

As used in the present specification and claims, the term "dispersed phase" of which the carbide phase has been considered in detail above, refers to a material having a VPN of greater than 1200 and a melting point of greater than 3000° F. Such dispersed phase in the present alloy systems, after consolidation, rarely or occasionally in the powders prior to consolidation, has a size ranging from ¼ to 3 microns. Such phase is uniformly dispersed.

Other alloy systems on which I have worked in accordance with the principles and teachings of this invention are set forthe in Table III, it being understood, of course, that my process is amenable to the making of numerous other alloy systems.

TABLE III

| Alloy No. | Chemical Composition, Percent given by weight | | | | | |
|---|---|---|---|---|---|---|
| 1 | 6% W | 5% Mo | 4% Cr | 2% V | 0.8% C | remainder substantially Fe |
| 2 | 6% W | 5% Mo | 4% Cr | 6% V | 1.1% C | remainder substantially Fe |
| 3 | 6% W | 5% Mo | 4% Cr | 9.1% V | 1.5% C | remainder substantially Fe |
| 4 | 6% W | 5% Mo | 4% Cr | 12.2% V | 1.8% C | remainder substantially Fe |
| 5 | 5.5% W | 4.7% Mo | 3.6% Cr | 5.25% V | 1.25% C | remainder substantially Fe |
| 6 | 5% W | 4.2% Mo | 3.2% Cr | 4.7% V | 1.7% C | remainder substantially Fe |
| 7 | "Tantung - G" a commercial alloy having approximately 30% Cr 15% W 2.5% C with remainder substantially Co. | | | | | |
| 8 | "Tantung - 144" a commercial alloy similar to Alloy No. 7 | | | | | |
| 9 | 6% W | 5% Mo | 4% Cr | 5% V | 1.4% C | remainder substantially Fe |
| 10 | 6% W | 5% Mo | 4% Cr | 5% V | 1.7% C | remainder substantially Fe |
| 11 | 6% W | 5% Mo | 4% Cr | 5% V | 1.7% C | remainder substantially Fe |
| 12 | 6% W | 5% Mo | 4% Cr | 5% V | 1.55% C | remainder substantially Fe |
| 13 | 6% W | 5% Mo | 4% Cr | 5% V | 1.8% C | remainder substantially Fe |
| 14 | 6% W | 5% Mo | 4% Cr | 5% V | 1.8% C[a] | remainder substantially Fe |
| 15 | 18% W | — | 4% Cr | 6% V | 1.8% C | remainder substantially Fe |
| 16 | 18% W | — | 4% Cr | 6% V | 2% C | remainder substantially Fe |
| 17 | 18% W | — | 4% Cr | 6% V | 2.2% C | remainder substantially Fe |
| 18 | 70% of alloy No. 15 with 30% Fe[b] | | | | | |
| 19 | 75% of alloy No. 15 with 15% Fe and 10% VC[b] | | | | | |
| 20 | 50% of alloy No. 10 with 50% of alloy No. 16[b] | | | | | |
| 21 | 6.5% W | 4% Mo | 4.5% Cr | 5% Co | 10% V | 2.35% C remainder substantially Fe |
| 22 | 6.5% W | 4% Mo | 4.5% Cr | 5% Co | 10% V | 2.75% C remainder substantially Fe |
| 23 | 6.5% W | 4% Mo | 4.5% Cr | 5% Co | 10% V | 3.15% C remainder substantially Fe |
| 24 | 2% W | 8% Mo | 4% Cr | 8% Co | 5% V | 2% C remainder substantially Fe |
| 25 | 17.5% W | — | 35.45% Cr | 45% Co | 2.05% C | |
| 26 | 6.5% W | 4% Mo | 4.5% Cr | 5% Co | 10% V | 3.4% C remainder substantially Fe |
| 27 | 6.5% W | 4% Mo | 4.5% Cr | 5% Co | 6% V | 4% Ti 3.4% C; remainder substantially Fe |
| 28 | 5% W | 6% Mo | 4% Cr | 12% Co | 8% V | 3% C remainder substantially Fe |
| 29 | 4% W | 5% Mo | 15% Cr | 8% Co | 8% V | 2.85% C remainder substantially Fe |

TABLE III-continued

| Alloy No. | Chemical Composition, Percent given by weight | | | | | |
|---|---|---|---|---|---|---|
| 30 | 8% W | 9% Mo | 6.5% Cr | 18% Co | 3.5% V | 1.8% C |
| | remainder substantially Fe | | | | | |
| 31 | 9% W | 6% Mo | 7% Cr | 8% Co | 8% V | 2.5% C |
| | remainder substantially Fe | | | | | |
| 32 | 8% W | 3% Mo | 12% Cr | 15% Co | 7% V | 2.5% C |
| | remainder substantially Fe | | | | | |
| 33 | 17.5% W | — | 35% Cr | — | — | 2.5% C |
| | remainder substantially Co | | | | | |
| 34 | 10% W | 5% Mo | 35% Cr | — | — | 2.5% C |
| | remainder substantially Co | | | | | |
| 35 | 9% W | 6% Mo | 20% Cr | 27% Co | | 3% C |
| | remainder substantially Fe | | | | | |
| 36 | 50% W | — | — | 50% Co | — | — |
| 37 | 47% W | — | — | 50% Co | — | 3% C |
| 38 | 56% W | — | — | 40% Co | — | 3.6% C |
| 39 | 12.5% W | 10% Co | 10% Cr | 3% Ti | 1.5% Al | 1.25% C |
| | remainder substantially Ni | | | | | |
| 40 | 15% W | 10% Co | 15% Cr | 3% Ti | 1.5% Al | 2% C |
| | remainder substantially Ni | | | | | |
| 41 | — | 16.8% Co | 20.75% Cr | 5% Mo | 3.25% Ti | 3.72% Al |
| | 0.955C; remainder substantially Ni | | | | | |
| 42 | 14.4% W | 9.6% Co | 16.63% Cr | 2.9% Ti | 4% Al | 2.49% C |
| | remainder substantially Ni | | | | | |
| 43 | 15.6% Co | 26.6% Cr | 4.6% Mo | 3% Ti | 3.43% Al | 2% C |
| | remainder substantially Ni | | | | | |
| 44 | 35% Cr | 17% W | 3% C | remainder substantially Co | | |
| 45 | 10% W | 5% Mo | 35% Cr | 2.5% C | | |
| | remainder substantially Co | | | | | |
| 46 | 15% W | 35% Cr | 4% Cb | 2.5% C | | |
| | remainder substantially Co | | | | | |
| 47 | 27.5% W | 25% Cr | — | 2.5% C | | |
| | remainder substantially Co | | | | | |
| 48 | 38.5% W | 14% Cr | — | 2.5% C | | |
| | remainder substantially Co | | | | | |

[a]differs from alloy 13 only in particle size of atomized powders.
[b]the constituent powders were blended and then consolidated (The Fe and VC particles were not atomized but merely blended with the atomized alloy).

The 58 alloy compositions set forth in Tables I and III are specific examples of solid alloys prepared by hot consolidation of prealloyed powders in accordance with the present invention. With the single exception of Alloy No. 38, all of the examples disclosed are alloys in which the base metal ($M_{base}$) is cobalt, iron, nickel or a mixture thereof. Alloy No. 38 consists essentially of 56 weight percent tungsten, 40 weight percent cobalt and 3.6 weight percent carbon and properly should be termed a tungsten carbide alloy rather than a cobalt-base alloy inasmuch as this alloy does not contain at least 50 percent cobalt. As is readily apparent from a consideration of the data presented in Table I and Table III, each of the other 57 alloys disclosed herein is a specific example of a class of iron group-base alloys (cobalt-, iron- or nickel-base) which exhibit the following compositional characteristics:

1. All of the examples of iron group-base alloys contain in the range of from 0.8 to 3.4% carbon.

2. All of the examples of iron group-base alloys contain substantial amounts of carbide forming elements selected from the group consisting of Cr, W, Mo, Ti, Ta, Cb and V.

More than half of the alloys disclosed contain 30% or more carbide forming elements. All of the cobalt-base alloys contain in excess of 30% carbide formers and more specifically in the range of 45 to 54% carbide formers.

3. All of the examples of iron group-base alloys contain in the range of from 43.5 to 81.2% base metal ($M_{base}$), and in the range of from 0 to 35.45% chromium. In each example the amount of $M_{base}$ exceeds the amount of chromium.

4. All of the examples of iron group-base alloys which include chromium as an alloying constituent, contain in the range from 43.5 to 81.2% base metal, and in the range of from 7.6 to 38.3% carbide formers other than chromium. In each example the amount of $M_{base}$ exceeds the total amount of carbide formers other than chromium.

5. All of the examples of iron group-base alloys contain a total amount of base metal plus chromium in the range of from 50 to 87%. In each example the total amount of $M_{base}$ plus chromium is at least 50%.

These compositional characteristics are seen more clearly in Table IV in which the data given in Table I and III for all of the alloys is organized for better comparison of chemical composition and grouped according to whether the base metal is cobalt, iron or nickel:

TABLE IV

COMPOSITIONAL CHARACTERISTICS OF IRON GROUP-BASE ALLOYS FROM DATA GIVEN IN TABLES I & III CHEMICAL COMPOSITION, PERCENT GIVEN BY WEIGHT

| Alloy No. | Carbon | Carbide Forming Elements | Base Metal ($M_{base}$) | Chromium (Cr) | Total Carbide-Formers Other Than Cr | Base Metal Plus Cr |
|---|---|---|---|---|---|---|
| COBALT-BASE ALLOYS | | | | | | |
| A 7 | 2.5 | 45 | 52.5 | 30 | 15 | 82.5 |
| B (8) | 2.5 | 45 | 52.5 | 30 | 15 | 82.5 |
| C 26 | 2.5 | 52.5 | 45 | 35 | 17.5 | 80 |
| D 34 | 2.5 | 52.5 | 45 | 35 | 17.5 | 80 |
| E 35 | 2.5 | 52.5 | 45 | 35 | 17.5 | 80 |
| F 45 | 2.5 | 49 | 48.5 | 32 | 17 | 80.5 |
| G 46 | 2.4 | 50.5 | 47.1 | 31 | 19.5 | 78.1 |

TABLE IV-continued

COMPOSITIONAL CHARACTERISTICS OF IRON GROUP-BASE ALLOYS FROM DATA GIVEN IN TABLES I & III CHEMICAL COMPOSITION, PERCENT GIVEN BY WEIGHT

| Alloy No. | Carbon | Carbide Forming Elements | Base Metal ($^{M}$base) | Chromium (Cr) | Total Carbide-Formers Other Than Cr | Base Metal Plus Cr |
|---|---|---|---|---|---|---|
| H 47 | 3 | 52 | 45 | 35 | 17 | 80 |
| J 48 | 2.5 | 50 | 47.5 | 35 | 15 | 82.5 |
| K 49 | 2.5 | 54 | 43.5 | 35 | 19 | 78.5 |
| L 50 | 2.5 | 52.5 | 45 | 25 | 27.5 | 70 |
| M 51 | 2.5 | 52.5 | 45 | 14.2 | 38.3 | 59.2 |
| 25 | 2.05 | 52.95 | 45 | 35.45 | 17.5 | 80.45 |
| 33 | 2.5 | 52.5 | 45 | 35 | 17.5 | 80 |
| 34 | 2.5 | 50 | 47.5 | 35 | 15 | 82.5 |
| 36 | 3 | 47 | 50 | — | 47 | 50 |
| 37 | 3 | 47 | 50 | — | 47 | 50 |
| 44 | 3 | 52 | 45 | 35 | 17 | 80 |
| 45 | 2.5 | 50 | 47.5 | 35 | 15 | 82.5 |
| 46 | 2.5 | 54 | 43.5 | 35 | 19 | 78.5 |
| 47 | 2.5 | 52.5 | 45 | 25 | 27.5 | 70 |
| 48 | 2.5 | 52.5 | 45 | 14 | 28.5 | 59 |
| IRON-BASE ALLOYS | | | | | | |
| 1 | 0.8 | 17 | 82.2 | 4 | 13 | 86.2 |
| 2 | 1.1 | 21 | 77.9 | 4 | 17 | 81.9 |
| 3 | 1.5 | 24.1 | 74.4 | 4 | 20.1 | 78.4 |
| 4 | 1.8 | 27.2 | 71 | 4 | 23.2 | 75 |
| 5 | 1.25 | 19.05 | 79.7 | 3.6 | 15.45 | 83.3 |
| 6 | 1.7 | 17.1 | 81.2 | 3.2 | 13.9 | 84.4 |
| 9 | 1.4 | 20 | 78.6 | 4 | 16 | 82.6 |
| 10 | 1.7 | 20 | 78.3 | 4 | 16 | 82.3 |
| 11 | 1.7 | 20 | 78.3 | 4 | 16 | 82.3 |
| 12 | 1.55 | 20 | 78.45 | 4 | 16 | 82.45 |
| 13 | 1.8 | 20 | 78.2 | 4 | 16 | 82.2 |
| 14 | 1.8 | 20 | 78.2 | 4 | 16 | 82.2 |
| 15 | 1.8 | 28 | 70.2 | 4 | 24 | 74.2 |
| 16 | 2 | 28 | 70 | 4 | 24 | 74 |
| 17 | 2.2 | 28 | 69.8 | 4 | 24 | 73.8 |
| 18 | 1.26 | 19.6 | 79.14 | 2.8 | 16.8 | 81.94 |
| 19 | 3.25 | 29.1 | 67.65 | 3 | 26.1 | 70.65 |
| 20 | 1.85 | 24 | 74.15 | 4 | 20 | 78.15 |
| 21 | 2.35 | 25 | 72.65 | 4.5 | 21.5 | 77.15 |
| 22 | 2.75 | 25 | 72.25 | 4.5 | 21.5 | 76.75 |
| 23 | 3.15 | 25 | 71.85 | 4.5 | 21.5 | 76.35 |
| 24 | 2 | 19 | 79 | 4 | 15 | 83 |
| 26 | 3.4 | 25 | 71.6 | 4.5 | 21.5 | 76.1 |
| 27 | 3.4 | 25 | 71.6 | 4.5 | 21.5 | 76.1 |
| 28 | 3 | 23 | 74 | 4 | 19 | 78 |
| 29 | 2.85 | 32 | 65.15 | 15 | 17 | 80.15 |
| 30 | 1.8 | 27 | 71.2 | 6.5 | 20.5 | 77.7 |
| 31 | 2.5 | 30 | 67.5 | 7 | 23 | 74.5 |
| 32 | 2.5 | 30 | 67.5 | 12 | 18 | 79.5 |
| 35 | 3 | 35 | 62 | 20 | 15 | 82 |
| NICKEL-BASE ALLOYS | | | | | | |
| 39 | 1.25 | 25.2 | 73.25 | 10 | 15.5 | 83.25 |
| 40 | 2 | 33 | 65.0 | 15 | 18 | 80.0 |
| 41 | 0.995 | 29 | 70.05 | 20.75 | 8.25 | 70.8 |
| 42 | 2.49 | 33.93 | 59.58 | 16.63 | 17.3 | 76.21 |
| 43 | 2 | 34.2 | 60.37 | 26.6 | 7.6 | 86.97 |

It will be understood that modifications and variations may be effected without departing from the scope of the novel concepts of the present invention.

What is claimed is:

1. A consolidated integral high speed steel alloy body which is essentially fully dense formed of a hot worked super-saturated solid solution of an inherently alloying composition, said alloy body consisting essentially of a continuous metallurgical phase with a uniformly dispersed hard phase of minute dispersed hard phase particle sizes that are essentially entirely less than 3 microns, said alloying composition consisting essentially by weight of from about 0.5% to about 5.0% carbon, at least 10% of a hard phase-forming element selected from the group consisting of Cr, W, Mo, Ti, Ta, Cb, Zr, Hf, V and Al, and mixtures thereof, and the remainder base metal and incidental impurities, wherein said base metal is iron, and wherein the total amount of iron is at least 30%.

2. A high speed steel cutting tool made from an alloy body as defined in claim 1.

3. A consolidated integral high speed steel alloy body which is essentially fully dense formed by a hot worked super-saturated solid solution of an inherently alloying composition, said alloy body consisting essentially of a continuous metallurgical phase with a uniformly dispersed hard phase of minute dispersed hard phase particle sizes that are essentially entirely less than 3 microns, said alloying composition consisting essentially by weight of from about 0.8% to about 3.4% carbon, at least 10% of a hard phase-forming element selected from the group consisting of Cr, W, Mo, Ti, Ta, Cb and V, and mixtures thereof, and the remainder base metal and incidental impurities, wherein said base metal is iron, and wherein the total amount of iron is at least 30%.

4. A high speed steel cutting tool made from an alloy body as defined in claim 3.

5. A consolidated integral high speed steel alloy body which is substantially fully dense as shown by an improved combination of transverse rupture strength and hardness in cutting tool applications, said body being formed of a hot worked super-saturated solid solution of an inherently alloying composition, said alloy body consisting essentially of a continuous metallurgical phase with a uniformly dispersed hard phase of minute dispersed hard phase particle sizes that are essentially entirely less than 3 microns, said alloying composition consisting essentially by weight of from about 0.8% to about 3.4% carbon, at least 10% of a hard phase-forming element selected from the group consisting of Cr, W, Mo, Ti, Ta, Cb, and V, and mixtures thereof, and the remainder base metal and incidental impurities, wherein said base metal is iron, and wherein the total amount of iron is at least 30%.

6. A high speed steel cutting tool made from an alloy body as defined in claim 5.

7. A consolidated integral high speed steel alloy body which is essentially fully dense as shown by an improved combination of transverse rupture strength and hardness in cutting tool applications, said body being formed of a hot worked super-saturated solid solution of an inherently alloying composition, said alloy body consisting essentially of a continuous metallurgical phase with a uniformly dispersed hard phase of minute dispersed hard phase particle sizes that are essentially entirely less than 3 microns, said alloying composition consisting essentially by weight of from about 0.8% to about 3.4% carbon, at least 10% of a hard phase-forming element selected from the group consisting of Cr, W, Mo, Ti, Ta, Cb, and V, and mixtures thereof, and the remainder base metal and incidental impurities, wherein said base metal is iron, and wherein the total amount of iron is at least 30%.

8. A high speed steel cutting tool made from an alloy body as defined in claim 7.

* * * * *